US006056390A

United States Patent [19]

Wakahara

[11] Patent Number: 6,056,390

[45] Date of Patent: May 2, 2000

[54] IMAGE FORMING APPARATUS WHEREIN THE VELOCITY OF THE TONER SUPPORTING MEDIUM IS HIGHER THAN RECORDING MEDIUM TRANSPORT VELOCITY

[75] Inventor: Shirou Wakahara, Osaka, Japan

[73] Assignee: Sharp Kabushiki Kaisha, Osaka, Japan

[21] Appl. No.: 08/859,371

[22] Filed: May 20, 1997

[30] Foreign Application Priority Data

May 28, 1996 [JP] Japan ..... 8-133279

[51] Int. Cl.[7] ..... B41J 2/06

[52] U.S. Cl. ..... 347/55

[58] Field of Search ..... 347/55, 120, 123, 347/111, 159, 141, 151, 127, 128, 17, 103, 154; 399/271, 290, 292, 293, 294, 295, 258

[56] References Cited

U.S. PATENT DOCUMENTS

| | | | |
|---|---|---|---|
| 5,386,225 | 1/1995 | Shibata | 347/55 |
| 5,508,723 | 4/1996 | Maeda | 347/55 |

FOREIGN PATENT DOCUMENTS

| | | |
|---|---|---|
| 0 709 748 | 5/1996 | European Pat. Off. . |
| 0 710 895 | 5/1996 | European Pat. Off. . |
| 0 720 072 | 7/1996 | European Pat. Off. . |
| 0 736 822 | 10/1996 | European Pat. Off. . |
| 0 788 887 | 8/1997 | European Pat. Off. . |
| 0 740 224 | 10/1997 | European Pat. Off. . |
| 6-155798 | 6/1994 | Japan . |

OTHER PUBLICATIONS

European Search Report dated Oct. 7, 1997 for EP 97 30 3614.

*Primary Examiner*—John Barlow
*Assistant Examiner*—Raquel Yvette Gordon
*Attorney, Agent, or Firm*—David G. Conlin; George W. Neuner; Dike, Bronstein, Roberts and Cushman LLP

[57] ABSTRACT

Peripheral velocity of a toner support is set up so as to satisfy the following condition:

$$L/T \leqq vs \leqq (d/t)\cdot\cos\theta-(1/t)(L^2-d^2\sin^2\theta)^{1/2}$$

assuming that d denotes the distance between centers of two adjacent gates, θ the angle of slant connected between centers of the same two gates, L the maximum length of toner-free area on peripheral surface of the toner support, vs the peripheral velocity of the toner support, t the time lag between voltage application to one annular electrode and to the other, and T is the time interval between successive voltage applications to an identical gate (the shortest period of time during which the voltage for inhibiting passage of the toner is applied to the gate).

2 Claims, 8 Drawing Sheets

IMAGE FORMING APPARATUS WHEREIN THE VELOCITY OF THE TONER SUPPORTING MEDIUM IS HIGHER THAN RECORDING MEDIUM TRANSPORT VELOCITY

BACKGROUND OF THE INVENTION (1) Field of the Invention

The present invention relates to an image forming apparatus such as a digital copier, facsimile machine, laser printer and the like, in particular relating to an image forming apparatus which forms images by causing developer particles to jump to the recording medium.

(2) Description of the Prior Art

Among image forming apparatuses for outputting image data as a visual image on recording medium such as recording paper etc., one type is known which directly forms a toner image on the recording medium by making toner, the developer, jump onto the recording medium, as has been disclosed in Japanese Patent Application Laid-Open Hei 6 No.155,798. As shown in FIG. 1, the image forming apparatus includes an image forming unit 51 having a toner supplying section 52 and a printing section 53. In this apparatus, toner 71 is made to jump from toner supplying section 52 and adhere to a sheet of paper 55, the recording medium. During this, the jumping of toner 71 is controlled in accordance with the image data.

Toner supplying section 52 is composed of a toner reservoir 70 for holding toner 71 as developer particles which are negatively charged, and a toner support 72 which supports toner 71 on its peripheral surface by magnetic force whilst rotating in the direction of arrow E. Printing section 53 is composed of an opposing electrode 75 of a cylindrical shape and a control electrode 76 which is provided between opposing electrode 75 and toner support 72. Opposing electrode 75 rotates in the direction of arrow F so that paper 55 is conveyed between opposing electrode 75 and control electrode 76 in the direction of arrow G.

As shown in FIG. 2A, control electrode 76 has a plurality of gates 79 formed therein, each gate 79 having an annular electrode 77 formed around the edge thereof. As the voltage from a control power source 81 shown in FIG. 1 is selectively applied to these annular electrodes 77 in accordance with the image data, toner 71 supported on the peripheral surface of toner support 72 is made to jump toward opposing electrode 75 and pass through selective gates 79 hence being made to adhere to paper 55 which is placed between opposing electrode 75 and control electrode 76.

The image forming apparatus configured as above is one which directly forms the image on the surface of recording medium such as paper etc. Therefore, it is no longer necessary to use a developer medium such as a photoreceptor etc., which was used in conventional image forming apparatuses. Further, the operation for transferring the image from the developer medium to the paper can be omitted, thus making it possible to eliminate degradation of the image due to the existence of this operation. Moreover, the structure of the apparatus can be simplified needing fewer parts, thus making it possible to reduce the apparatus in size and cost.

However, in the above conventional image forming apparatus, since the peripheral velocity of toner support 72 and the conveying speed of paper 55 are equal, if an arbitrary gate 79*n* has been made to pass toner 71 therethrough and subsequently the adjoining gate 79*n*+1 is made to pass toner 71 therethrough as shown in FIG. 2B, a toner-free area will be produced on the peripheral surface of toner support 72 by the transfer of toner 71 through gate 79*n*. Because toner support 72 rotates during the time between the two events, part of this area overlaps the subsequent printing area designated at 72*n*+1 on the peripheral surface of toner support 72 that opposes gate 79*n*+1 as shown in FIG. 2C. As a result, area 72*n*+1 on the peripheral surface of toner support 72 might partially lack the toner 71, which may be needed for later transfer. Therefore, the amount of toner 71 transferred through gate 79*n*+1 becomes low resulting in insufficient dot density and dot diameter in the formed image, lowering the image contrast and degrading the reproduction of halftone. In color image forming apparatus, it becomes impossible to reproduce the desired colors. Moreover, image deficiency such as white strips and color voids may occur.

In order to avoid such degradation of the image, it is considered that the density of toner 71 on the peripheral surface of toner support 72 needs to be increased. However, there is a limit for the toner density on toner support 72, and it is impossible to obtain an adequate toner density under the present conditions. Further, in this case, the thickness of the toner layer on toner support 72 tends to become unstable and in some cases, it may become difficult to obtain the desired layer thickness, making it impossible to form an stable image.

Moreover, when the thickness of the toner layer on toner support 72 is enhanced to increase the density of toner 71, the distance between control electrode 76 and toner 71 becomes shortened. This means that toner 71 becomes more likely to adhere to control electrode 76 and becomes further unstable in its layer thickness. If toner 71 has adhered to control electrode 76, the potential created by the charge carried by toner 71 changes the potential of control electrode 76 resulting in an ineptness in controlling the potential used for image forming. This also causes obstruction or clogging in gates 79.

In order to avoid the above situation, if control electrode 76 is made more distant from toner support 72, the potentials to be applied to toner support 72, opposing electrode 75 and control electrode 76 need to be increased, resulting in increase in cost for the power source. In addition, the elevation of the potential applied to opposing electrode 75 requires a more thorough insulation and also the price for the high-voltage driver for switching the potential applied to control electrode 76 increases.

SUMMARY OF THE INVENTION

It is therefore an object of the present invention to provide an image forming apparatus wherein the peripheral velocity of the toner support is set up based on conditions of the arrangement of the gates in the control electrode and the shape and feature of the area where no developer adhere to, which is produced on the peripheral surface of the toner support, whereby when the developer has been made to jump through an arbitrary gate and subsequently the developer is made to jump through its adjoining gate, it is possible to prevent the amount of the developer at the second transfer from being affected by the developer free-area which has been produced on the peripheral support of the toner support by the first developer transfer and it is possible to secure an adequate amount of developer even when the developer is made to jump through a plurality of adjoining gates and thus degradation of image forming states such as image defects or void etc., due to an insufficient amount of developer can be definitely prevented.

The present invention has been devised to attain the above object, and the gist of the invention is as follows:

In accordance with the first aspect of the invention, an image forming apparatus comprises: a supporting medium for supporting the developer; an opposing electrode spaced a predetermined distance apart from the supporting medium and disposed facing the supporting medium; a control electrode disposed between the supporting medium and the opposing electrode and having a plurality of gates which form passage for the developer particles; and a drive controlling means which moves the surface of the supporting medium at a constant velocity relative to the control electrode, so that the image forming apparatus forms a visual image on a recording medium conveyed between the opposing electrode and the control electrode whilst varying the potential applied to the control electrode so as to selectively control transfer of the developer particles through the gates, and is constructed such that the moving velocity of the supporting medium surface controlled by the drive controlling means is set at a higher rate than the moving velocity of the recording medium relative to control electrode.

Next, in accordance with the second aspect of the invention, an image forming apparatus having the above first feature is constructed such that the moving velocity of the supporting medium surface controlled by the drive controlling means is set up based on the moving velocity of recording medium relative to the control electrode, conditions of the arrangement of the gates in the control electrode and the size of the area where no developer adhere to, which is produced on supporting medium surface by the transfer of the developer through the gate.

In accordance with the third aspect of the invention, an image forming apparatus having the above second feature is constructed such the moving velocity vs of the supporting medium surface controlled by the drive controlling means is set up so as to satisfy the following condition:

$$vs \leqq (d/t) \cdot \cos\theta - (1/t)(L^2 - d^2\sin^2\theta)^{1/2}$$

where t is the shortest time interval between the voltage application to one gate and the voltage application to the proximal gate, d is the distance between the centers of the two gates for which the times of voltage application is closest to each other, L is the maximum length of developer-free area on the supporting medium surface, and θ is the angle of the slant connected between the centers of the two gates for which the times of voltage application is closet to each other, with respect to the conveying direction of the recording medium.

Finally, in accordance with the fourth and fifth aspect of the invention, an image forming apparatus having the above second or third feature is constructed such that the moving velocity vs of the supporting medium surface controlled by the drive controlling means is set up so as to satisfy the following condition:

$$L \leqq vs \cdot T$$

where L is the maximum length of developer-free area on the supporting medium surface and T is the shortest period of time during which the voltage for inhibiting passage of the developer is applied to an identical gate.

DESCRIPTION OF THE PREFERRED EMBODIMENTS

Figure 1:
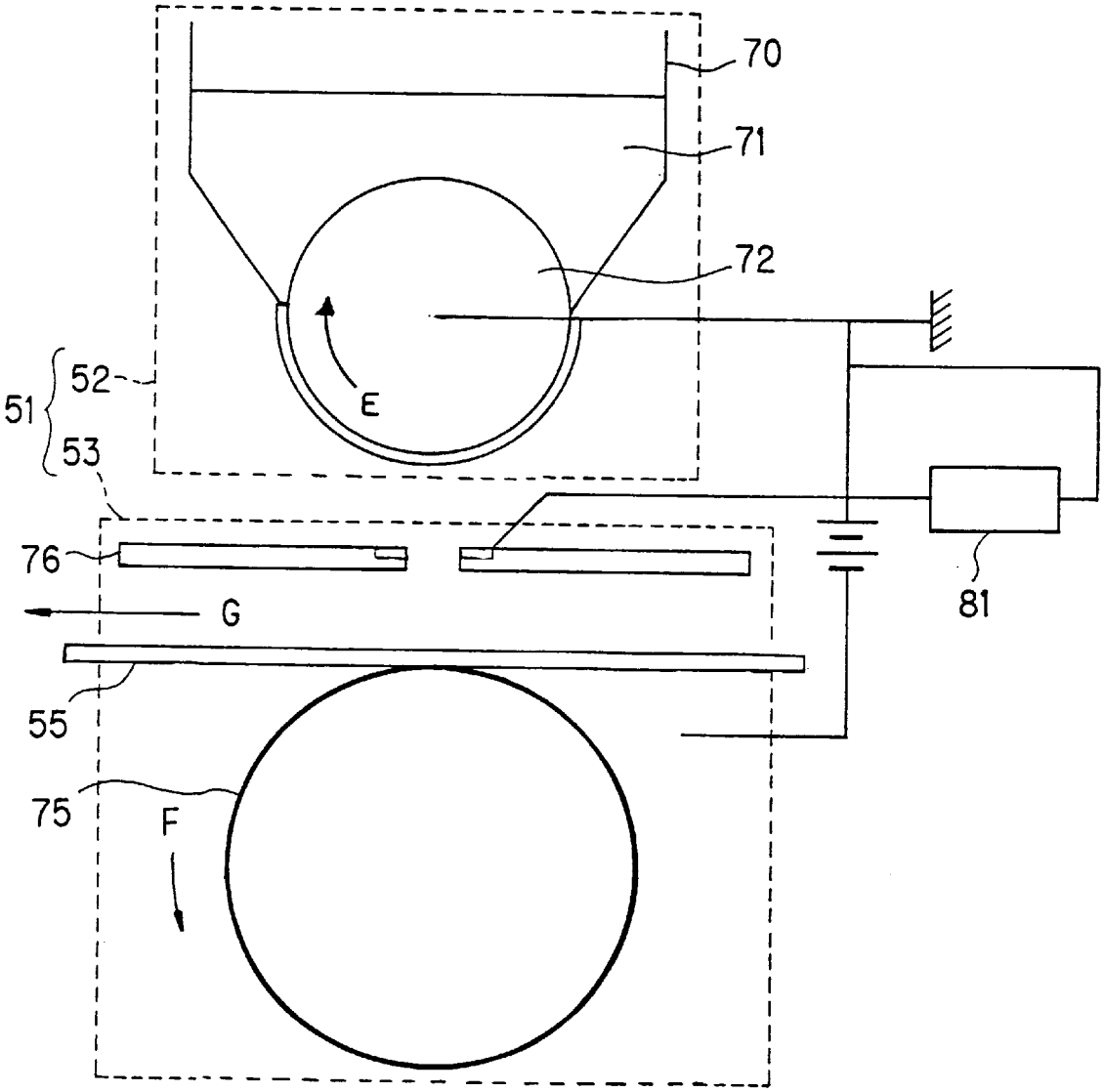
FIG. 1 PRIOR ART
FIG. 1 is a schematic view showing the configuration of essential components of a conventional image forming apparatus.
Figure 2A:
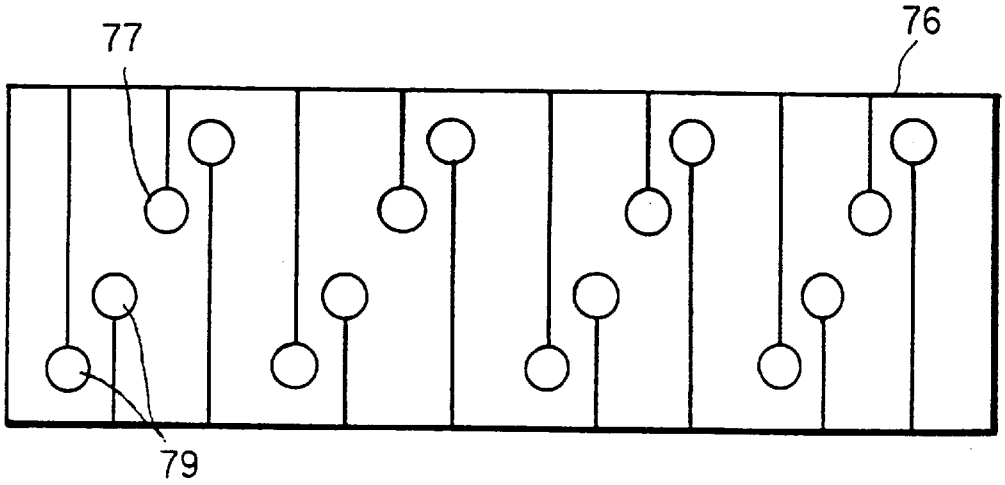
FIG. 2A PRIOR ART
FIGS. 2A–2C are views showing a forming state of the toner-free area on the toner support in the same conventional image forming apparatus.
Figure 2B:
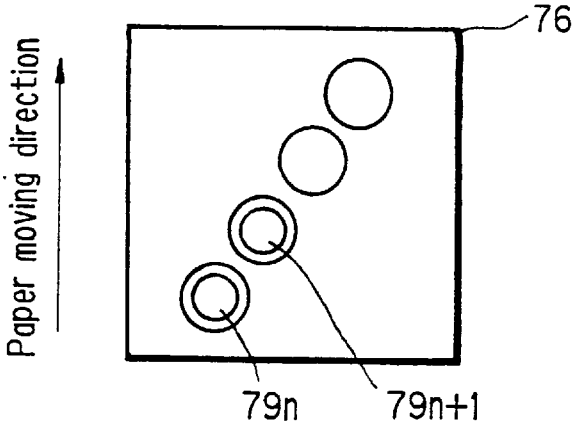
FIG. 2B PRIOR ART
Figure 2C:
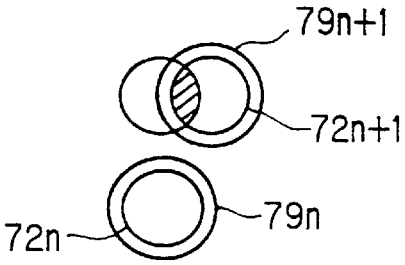
FIG. 2C PRIOR ART
Figure 3:
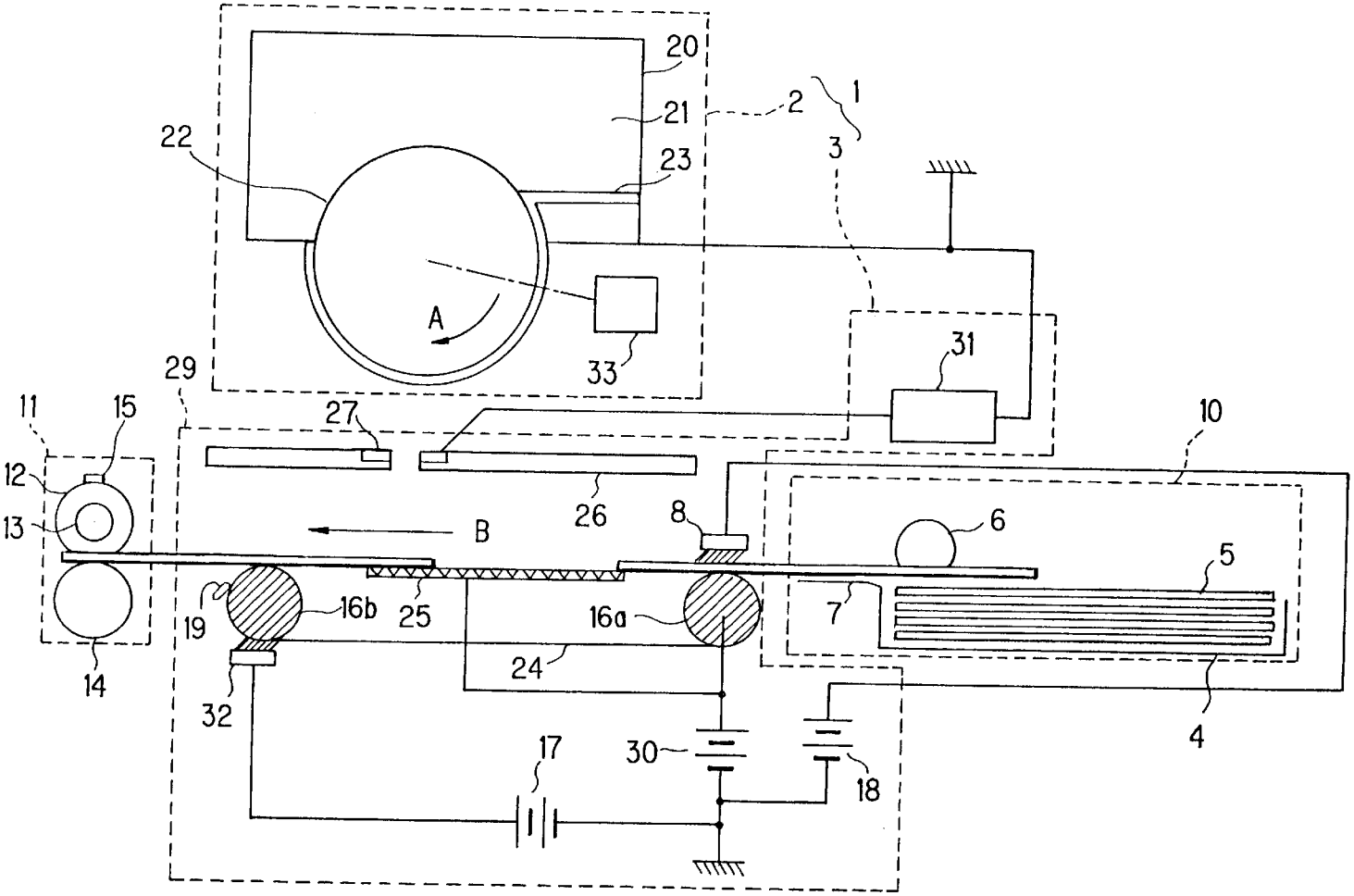
FIG. 3 is a schematic view showing the configuration of essential components of an image forming apparatus to which the present invention is applied.

FIG. 3 is a view showing the configuration of an image forming apparatus of a typical embodiment of the invention. This image forming apparatus has an image forming unit 1 which is composed of a toner supplying section 2 and a printing section 3. Image forming unit 1 creates a visual image in accordance with an image signal, onto a sheet of paper as recording medium with toner as the developer. In this image forming apparatus, the toner is made to jump and adhere onto the paper whilst the jumping of the toner is controlled based on the image forming signal, so as to directly form the image on the paper. Provided on the paper input side of image forming apparatus 1 is a paper feeder 10, which is composed of a paper cassette 4 for storing sheets of paper 5 as recording medium, a pickup roller 6 for delivering paper 5 supplied from paper cassette 4, and a paper guide 7 for guiding paper 5 sent out. Pickup roller 6 receives rotational force from an unillustrated driver.

Provided on the output side of image forming apparatus 1 is a fixing unit 11 for heating and pressurizing the toner image which was formed on paper 5 at the image forming unit 1, to fix it onto paper 5. Fixing unit 11 is composed of a heat roller 12, a heater 13, a pressure roller 14, a temperature sensor 15, and an unillustrated temperature controller circuit. Heat roller 12 is made up of, for example, an aluminum pipe of about 2 mm thick. Heater 13 is a halogen lamp, for example, which is incorporated in heat roller 12. Pressure roller 14 is a pipe made up of silicone resin, for example. Heat roller 12 and pressure roller 14 are pressed against one another with a constant pressure. Temperature sensor 15 measures the surface temperature of heat roller 12. Temperature controlling circuit (unillustrated) controls the operation of heater 13 based on the measurement result from temperature sensor 15 so that the surface temperature of heat roller 12 is maintained at 150° C., for example, which allows the melting of the toner. Fixing unit 11 has an unillustrated paper discharge sensor for detecting the discharge of paper 5. Here, fixing unit 11 may be constructed so that the toner image is fixed by heating or pressing paper 5.

Toner supplying section 2 in image forming apparatus 1 is composed of a toner reservoir 20 for storing toner 21 as the developer, a cylindrical support 22 for magnetically supporting toner 21, a doctor blade 23 which imparts charge to toner 21 and regulates the thickness of the toner layer carried on the peripheral surface of toner support 22. Doctor blade 23 is arranged on the upstream side of toner support 22 with respect to the rotational direction of the peripheral surface of toner support 22, spaced with a distance of about 60 $\mu$m, for example, from the peripheral surface of toner support 22. Toner 21 is of a magnetic type having a mean particle diameter of, for example, 6 $\mu$m, and is electrified with static charge of −4 $\mu$C/g to −5 $\mu$C/g by doctor blade 23.

Toner support 22 receives rotational force from driver controller 33 so that it rotates at a constant peripheral speed in the direction indicated by arrow A. Toner support 22 is grounded and has unillustrated fixed magnets therein, at the position opposite doctor blade 23 and at the position opposite a control electrode 26 (which will be described later). This arrangement permits toner support 22 to magnetically carry toner 21 on its peripheral surface, and toner 21 supported on the peripheral surface of toner support 22 is made to stand up in 'spikes' at the areas corresponding to the positions of the magnets. Toner support 22 can be configured so as to support toner 21 by electric force or combination of electric and magnetic forces.

Printing section 3 includes: a dielectric belt 24 tensioned between a pair of support rollers 16a and 16b at the position opposite the peripheral surface of toner support 22; an opposing electrode 25 which is in contact with the inner peripheral surface of the upper side of dielectric belt 24; a high-voltage power source 30 for applying a high voltage to opposing electrode 25; a control electrode 26 provided between toner support 22 and opposing electrode 25; a charge eraser brush 32 which is in contact with the outer peripheral surface of dielectric belt 24; a charge eraser power source 17 for imparting a charge eraser voltage to charge eraser brush 32; a cleaner 19 abutting the outer peripheral surface of dielectric belt 24; and a charging brush 8 for electrifying paper 5 whilst it is being conveyed along the upper surface of dielectric belt 24.

Opposing electrode 25 is made up of an aluminum plate of, for example, about 1 mm thick, and is arranged about 1 mm apart from the peripheral surface of toner support 22. Dielectric belt 24 is made of, for example, PVDF as a base material of about 75 $\mu$m thick with a volume resistivity of about $10^{10}$ Ω·cm. Support rollers 16*a* and 16*b* supporting dielectric belt 24 is rotated by an unillustrated driver in the direction of arrow B at a constant peripheral velocity. Applied to opposing electrode 25 is a high voltage, e.g., 2.3 kV from high voltage power source 30. This arrangement generates an electric field between opposing electrode 25 and toner support 22, required for causing toner 21 being supported on the peripheral surface of toner support 22 to jump toward opposing electrode 25.

Charge eraser brush 32 is pressed against dielectric belt 24 on the control electrode 26 side, relative to the rotational direction of dielectric belt 24. Charge eraser brush 32 has an eraser potential of, for example, about 2.5 kV applied from charge eraser power source 17 so as to eliminate unnecessary charges on the surface of dielectric belt 24. Cleaner 19 removes the toner adhering to the outer peripheral surface of dielectric belt 24. For example, if paper jam or some other defects occur, the toner adhering to the outer peripheral surface of dielectric belt 24 stains the underside of the next conveyed paper 5. The cleaner prevents this.

It should be noted that this image forming apparatus includes: a main controller as a control circuit for controlling the whole image forming apparatus; an image processor for converting the image data which was obtained from image pickup device into an image data format by which the image can be printed; an image memory for storing the converted image data; and an image forming control unit for converting the image data obtained from the image processor into the image data to be given to control electrode 26.

Figure 4:
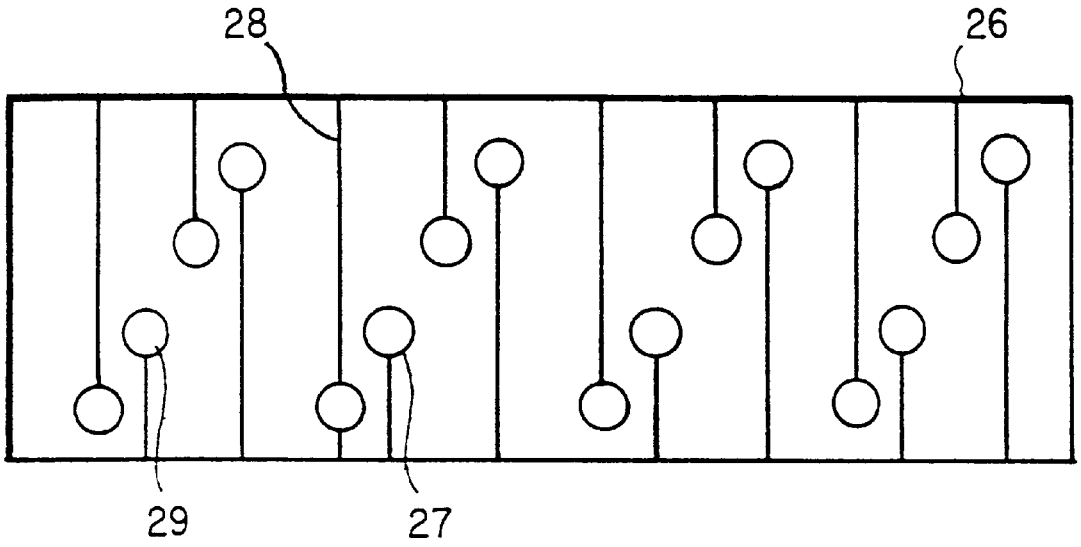
FIG. 4 is a plan view showing essential components of a control electrode provided in the same image forming apparatus.

FIG. 4 is a plan view showing the control electrode provided in the above image forming apparatus. Control electrode 26 is supported parallel to opposing electrode 25 by means of an unillustrated supporter member so that its distance from the peripheral surface of toner support 22 is set at, for example, 100 $\mu$m. Control electrode 26 is composed of an insulative plate-like member made of a polyimide resin or the like of about 75 $\mu$m thick with a plurality of annular electrodes 27 formed independently of each other. Annular electrodes 27 are individually formed around the edges of respective plural holes or gates 29. Annular electrodes 27 are formed of copper foil, for example, of 30 $\mu$m. Each gate 29 forms a passage for toner 21 to jump from the peripheral surface of toner support 22 toward opposing electrode 25. Each annular electrode 27 is connected to a control power source 31 via a respective feeder line 28 and an unillustrated high voltage driver. In control electrode 26, gates 29 as well as annular electrodes 27 are formed at 2,560 sites, for instance. This number corresponds to a resolution of 300 DPI across the width of A4 sized paper, or in the direction perpendicular to the conveyance direction of the paper. The surface of annular electrodes 27 as well as the surface of feeder lines 28 is coated with an insulative layer of 30 $\mu$m thick, thus ensuring insulation between annular electrodes 27, insulation between feeder lines 28, and insulation between annular electrodes 27 and feeder lines 28, not related to each other.

By controlling the potential to be applied to annular electrodes 27 of control electrode 26, the intensity of the electric field created between toner support 22 and opposing electrode 25 is changed so that the jumping of toner 21 from toner support 22 to opposing electrode 25 is controlled. Specifically, selective voltages are applied to annular electrode 27 from control power source 31 in accordance with the image data. When toner 21 supported on toner support 22 needs to be transferred toward opposing electrode 25, control power source 31 applies a voltage, e.g., 150 V to annular electrodes 27, whereas it applies another voltage, e.g., −200 V when the toner is not to be transferred. In this way, whilst the potential to be imparted to control electrode 26 is controlled in accordance with the image data, paper 5 is fed along opposing electrode 25 on the side thereof facing toner support 22. As a result, the toner image is formed on the surface of paper 5 in accordance with the image data. Here, control power source 31 is controlled by a control-electrode controlling signal transmitted, from an unillustrated image forming control unit.

Figure 5:
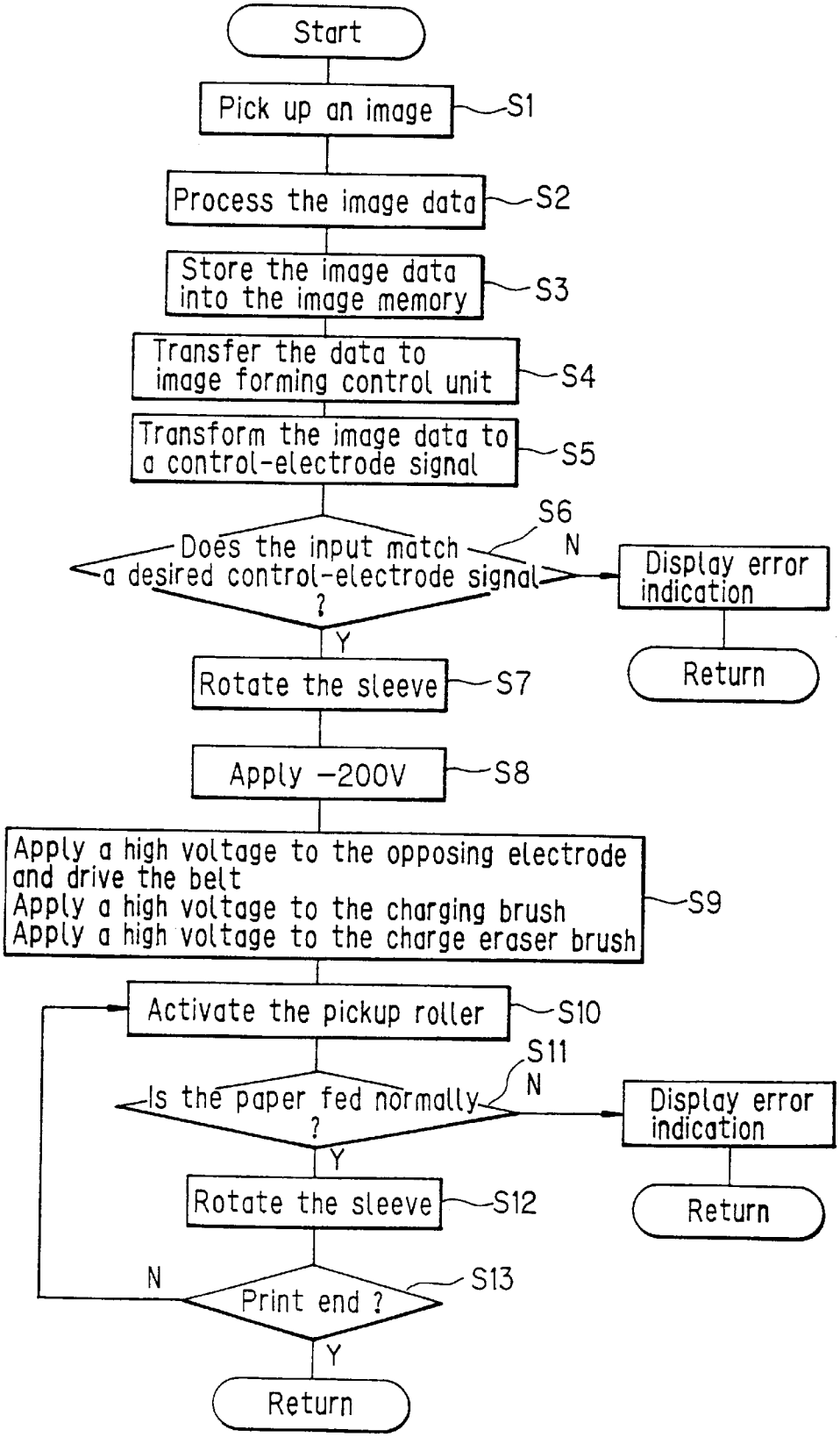
FIG. 5 is a flowchart showing the procedural flow of an image forming operation in the same image forming apparatus.

FIG. 5 is a flowchart showing the procedural flow of the image forming operation of the image forming apparatus. When the copy start key is operated with an original set on the image pickup section, the image reading operation is effected. Illustratively, the image pickup section reads the original image, and the image data thus picked up is image processed in the image processing section to be stored into the image memory (s1–s3). This image data is transferred to the image forming control unit at a predetermined timing (s4) so that the image forming control unit transforms the input image data into a control-electrode controlling signal to be imparted to control electrode 26 (s5). When the image forming control unit has created a predetermined amount of the control signal, it causes toner support 22 to rotate (s6, s7) while a voltage of −200 V is applied to control electrode 26 (s8). At the same time, the same voltage as applied to opposing electrode 25 also is applied to roller 16*a* from high voltage power source 30 (s8). Charging brush 8 is applied with a charging potential of 1.2 kV from charger power source 18 while charge eraser brush 32 is applied with an erasing potential from charge eraser power source 17 (s9).

Thereafter, an unillustrated driver is activated to start rotating pickup roller 6 (s10). This rotation of pickup roller 6 delivers a sheet of paper out from paper cassette 4 toward image forming unit 1. After it has been judged whether paper 5 has been fed normally or not (s1), it is conveyed between charging brush 8 and dielectric belt 24. Paper 5 is supplied with charge due to the potential difference between charging brush 8 and dielectric belt 24. Electrostatically attracted to dielectric belt 24, paper 5 is conveyed with the rotational movement of dielectric belt 24, to a position in printing section 3, where it faces toner support 22.

Next, the image forming control unit supplies the control-electrode controlling signal to control power source 31 so that control power source 31 applies a high voltage to annular electrodes 27 of control electrode 26 (s12). This control-electrode controlling signal is supplied at a time synchronized with the conveyance of paper 5 by dielectric belt 24. Control power source 31 controls the high voltage to be applied to annular electrodes 27 based on the control-electrode controlling signal. Illustratively, a voltage, 150 V or −200 V is applied to each of designated annular electrodes 27 from control power source 31 so as to control the electric field near control electrode 26. That is, at each gate 29 of control electrode 26, the jumping of toner 21 from toner support 22 toward opposing electrode 25 is inhibited or permitted in accordance with the image data so that the toner image, in conformity with the image signal, is formed on paper 5 which is moving at the rate of 30 mm/sec toward the paper output side by the rotational movement of dielectric belt 24. Paper 5 with the toner image formed thereon is separated from dielectric belt 24 by the curvature of roller 16b and is conveyed to fixing unit 11, where the toner image is fixed to paper 5. Paper 5 with the toner image fixed thereon is discharged by an unillustrated discharge roller onto a paper output tray.

Figure 6A:
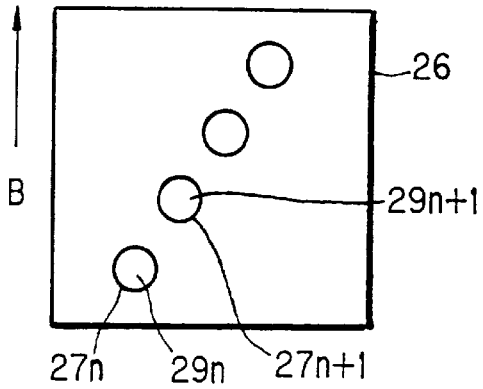
FIGS. 6A and 6B are views showing a forming state of the toner-free area on the toner support in the same image forming apparatus when the present invention is not applied thereto.
Figure 6B:
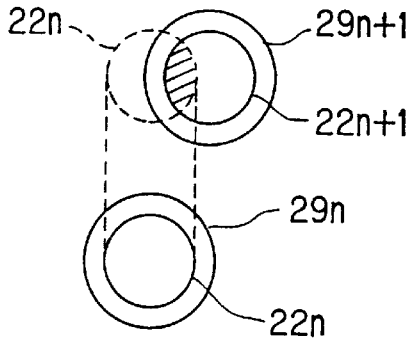

FIGS. 6A and 6B are enlarged views showing essential components of the control electrode. In FIG. 6A, when gate 29*n* and 29*n*+1 are both activated to allow passage of toner 21 forming an image, voltage is first applied to annular electrode 27*n* of gate 29*n* and then applied to annular electrode 27*n*+1 of gate 29*n*+1. The voltage application to annular electrode 27*n* causes toner 21 to jump from the portion facing gate 29*n* on the peripheral surface of toner support 22 toward opposing electrode 25 thus forming a toner-free area 22*n* where no toner 21 exists as shown in FIG. 6B. In this situation, when the voltage application to annular electrode 27*n*+1 is effected, toner-free area 22*n*+1 will be formed in the portion facing gate 29*n*+1 on the peripheral surface of toner support 22. At this moment, the rotation of toner support 22 during the time lag between the voltage application to annular electrode 27*n* and to annular electrode 27*n*+1 causes toner-free area 22*n* to move to a position indicated by the dashed line in FIG. 6B.

In general, a plurality of gates 29 formed on control electrode 26 as a whole correspond to one line at right angle to the conveyance direction of the image. Therefore, if the movement of toner-free area 22*n* due to the rotation of toner support 22 during the time interval between voltage application to annular electrode 27*n* and to annular electrode 27*n*+1 is equal to the distance between gates 29*n* and 29*n*+1, part of area on toner support 22 facing gate 29*n*+1 overlaps toner-free area 22*n* as shown in FIG. 6B when voltage application is performed to annular electrode 27*n*+1. For this reason, when voltage application is performed to annular electrode 27*n*+1, the amount of toner 21 transferred from the peripheral surface of toner support 22 decreases, causing a partial void in the image formed on paper 5.

In order to avoid such a defect or partial void of the image, it is considered that the density of toner 21 on the peripheral surface of toner support 22 needs to be increased. However, there is a limit for the toner density on toner support 22, and it is impossible to obtain an adequate toner density under the present conditions. Further, in this case, the thickness of the layer of toner 21 tends to become unstable and in some cases, it may become difficult to obtain the desired layer thickness, making it impossible to form an stable image.

Moreover, as the thickness of the toner layer is enhanced to increase the density of toner 21, the distance between control electrode 26 and the layer of toner 21 becomes shortened. This means that toner 21 becomes more likely to adhere to control electrode 26 and becomes even further unstable in its layer thickness. If toner 21 has adhered to control electrode 26, the potential created by the charge carried by toner 21 changes the potential of control electrode 26 resulting in an ineptness in controlling the potential used for image forming. This also causes obstruction or clogging in gates 29. In order to avoid the above situation, if control electrode 26 is made more distant from toner support 22, the potentials to be applied to toner support 22, opposing electrode 25 and control electrode 26 need to be increased, resulting in increase in cost for the power source. In addition, the elevation of the potential applied to opposing electrode 25 requires a more thorough insulation and also the price for the high-voltage driver for switching the potential applied to control electrode 26 increases.

More detailedly, the aforementioned problem arises in the following mechanism. That is, when toner 21 has been made to jump through an arbitrary gate 29*n* and subsequently toner 21 is made to jump through its adjoining gate 29*n*+1, toner-free area 22*n* produced on the peripheral surface of toner support 22 by the previous transfer through gate 29*n* overlaps the subsequent printing area designated at 22*n*+1 on the peripheral surface of toner support 22 that opposes gate 29*n*+1, thus area 22*n*+1 on the peripheral surface of toner support 22 partially lacks toner 21. Therefore, the amount of toner 21 supplied becomes low resulting in insufficient dot density and dot diameter in the formed image, lowering the image contrast and degrading the reproduction of halftone. In color image forming apparatus, it becomes impossible to reproduce the desired colors. Moreover, image deficiency such as white strips and color voids may occur.

The above problem can be solved by specifying the peripheral velocity of toner support 22 based on the diameter and positional relationship of gates 29. More detailedly, the peripheral velocity of toner support 22 is regulated so that toner-free area 22*n* on the peripheral surface of toner support 22 which has been produced by the transfer of toner 21 through gate 29*n*, moves to a position where it will not overlap toner-free area 22*n*+1 facing gate 29*n*+1 when annular electrode 27*n*+1 provided in gate 29*n*+1 adjoining gate 29*n* is voltage applied.

Figure 7A:
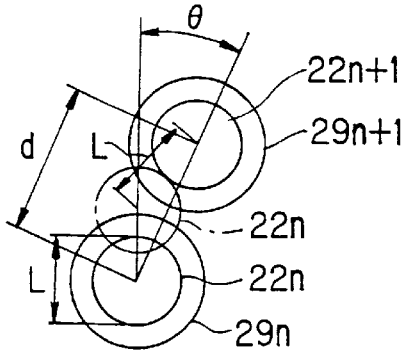
FIGS. 7A and 7B are views showing a forming state of the toner-free area on the toner support in the same image forming apparatus when the present invention is applied thereto.

As shown in FIG. 7A, assuming that d denotes the distance between the centers of gate 29*n* and 29*n*+1, θ the angle of the slant connected between the centers of gate 29*n* and 29*n*+1, L the maximum length of toner-free area 22*n* on the peripheral surface of toner support 22, vs the peripheral velocity of toner support 22, t the time lag between voltage application to annular electrode 27*n* and to annular electrode 27*n*+1, the following condition should be satisfied:

$$vs \cdot t \leqq d\cos\theta - (L^2 - d^2\sin^2\theta)^{1/2}.$$

Accordingly, the peripheral velocity vs of toner support 22 must satisfy the following condition (1):

$$vs \leqq (d/t)\cdot\cos\theta - (1/t)(L^2 - d^2\sin^2\theta)^{1/2} \quad (1)$$

In this way, it is possible to set the peripheral velocity vs of toner support 22 at a rate higher than the conveyance speed of paper 5.

Figure 7B:
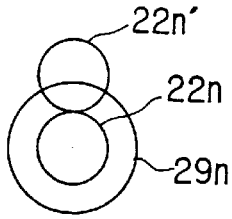

Further, when successive voltage applications to the same annular electrode 27*n* of gate 29*n* are effected, the currently forming toner-free area 22*n* on the peripheral surface of toner support 22 needs to be adapted so as not to overlap the toner-free area 22*n*' formed at the time of the previous application of voltage to annular electrode gate 29*n*. To meet this requirement, by the time when annular electrode 27*n* of gate 29*n* is voltage applied again, the previous toner-free area 22*n*' must at least move up to the position shown in FIG. 7B, or the position where it does not overlap the toner-free area 22*n* to be formed at the current event.

When annular electrode 27*n* of gate 29*n* is voltage applied successively at a time interval of T, the following condition also needs to be satisfied:

$$L \leqq vs \cdot T \quad (2)$$

From the above conditions (1) and (2), the peripheral velocity vs of toner support 22 should fall within the following range:

$$L/T \leqq vs \leqq (d/t)\cdot\cos\theta - (1/t)(L^2 - d^2\sin^2\theta)^{1/2}$$

Now, suppose L=203 μm, d=370 μm, θ=13°, t=400 μsec and T=2.5 μsec, the peripheral velocity vs of toner support 22 should be above about 81 mm/sec and below about 438 mm/sec.

Figure 8A:
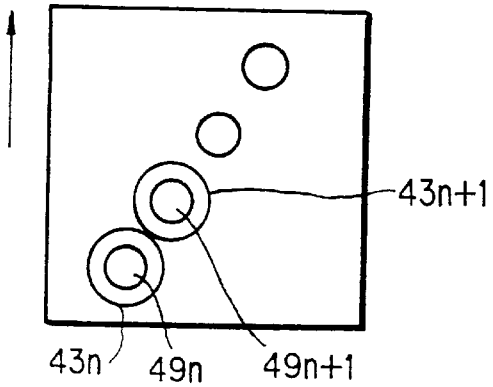
FIGS. 8A and 8B are views showing a forming state of the toner-free area on the toner support in the same image forming apparatus when the present invention is not applied thereto.
Figure 8B:
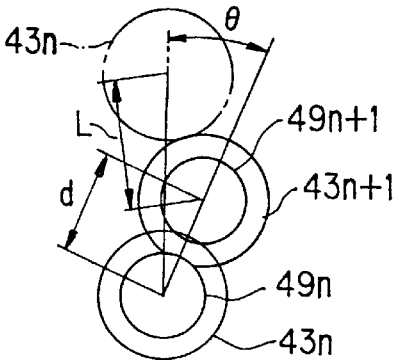

Thus, when L≦d, the peripheral velocity vs of toner support 22 will take a realistic value, but when L≧d, the peripheral velocity vs of toner support 22 will take an extremely large value resulting in an unreality. For example, in a control electrode 46 with a plurality of gates 49 and annular electrodes 47 arranged as shown in FIG. 8A, in order to solve the above problem, toner-free area 43*n* needs to be moved to the position clearing toner-free area 43*n*+1 as shown in FIG. 8B when the toner is made to pass through gate 49*n*+1. To meet this, the peripheral velocity vs of toner support 22 must satisfy the following condition:

$$vs \geqq (d/t)\cdot\cos\theta - (1/t)(L^2 - d^2\sin^2\theta)^{1/2}.$$

In this case, the peripheral velocity vs will take such a large value as vs≧1803 mm/sec. Therefore, the peripheral velocity of toner support 22 should and can be limited within a realistic range by imposing the condition, i.e., L≦d.

Figure 9:
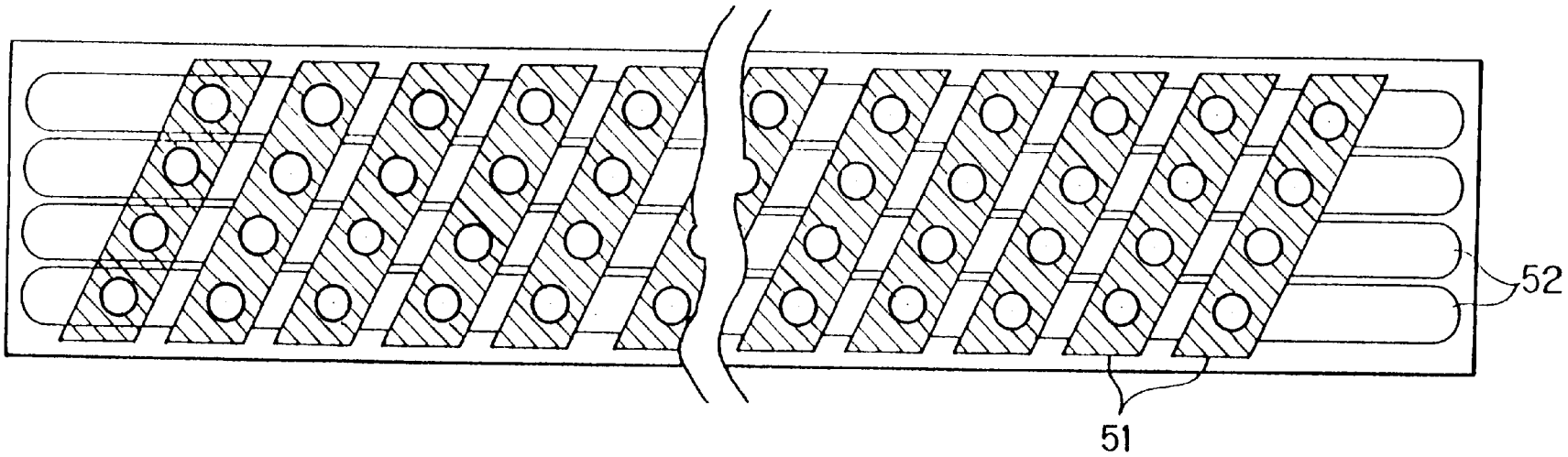
FIG. 9 is a plan view showing essential components of a control electrode provided in another image forming apparatus to which the present invention is applied.

In the above embodiment, although toner was used as the developer, it is also possible to use ink. Further, instead of using control electrode 26 having annular electrodes 27, it is also possible to control toner transfer from the toner support by providing a plurality of strip-like electrodes 51 and 52 matrix-wise on both sides of the substrate as shown in FIG. 9 and governing the voltage to be applied to the strip-like electrodes crossing over each other at right angles or at an angle.

Figure 10:
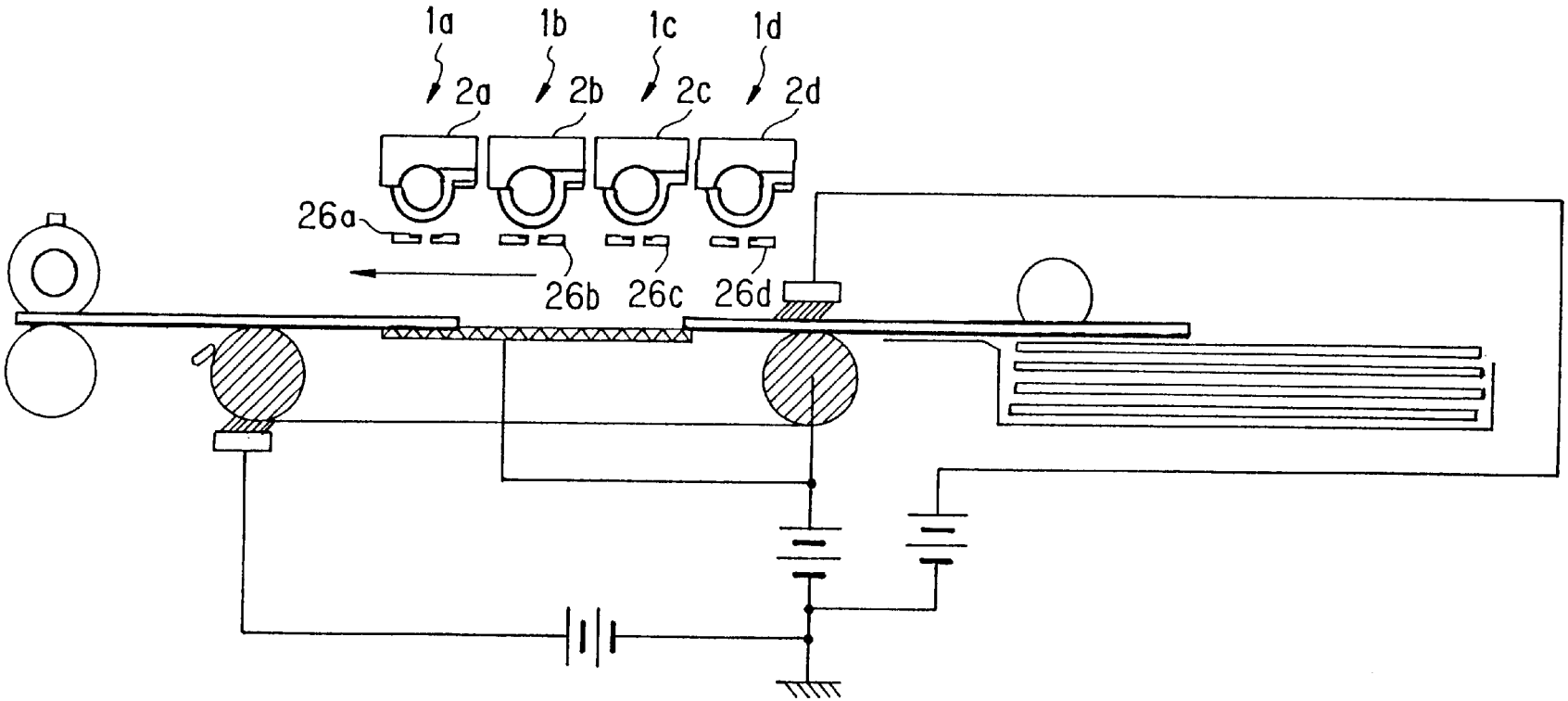
FIG. 10 is a schematic view showing the configuration of essential components of a color image recording apparatus to which the present invention is applied.

Further, the present invention can be applied in the same manner to a color image forming apparatus, as shown in FIG. 10, which has a plurality of image forming units 1*a*–1*d* made up of toner supplying sections 2*a*–2*d* and control electrodes 26*a*–26*d* wherein toner supplying sections 2*a*–2*d* are filled with toners, e.g., yellow, magenta, cyan and black. By applying the present invention to the thus configured color image forming apparatus, it is possible to secure the desired amount of toner to obtain adequate dot size and dot density, making it possible to create color images excellent in color reproduction.

The present invention can be also applied in the same manner to a configuration which uses an ion flow process in its toner supplying section.

Although in the above example, the conditions were defined based on the relationship between two gates which are positionally located next to each other was defined, it is also possible to apply the invention in a similar manner to a case where two gates which allow passage of toner in the closest timing are not positionally located next to each other.

According to this invention, when the developer has been made to jump through an arbitrary gate of the control electrode and subsequently the developer is made to jump through its adjoining gate, it is possible to prevent the amount of the developer at the second transfer from being affected by the developer free-area which has been produced on the peripheral support of the toner support by the first developer transfer, and therefore it is possible to secure an adequate amount of developer even when the developer is made to jump through a plurality of adjoining gates. Accordingly, degradation of image forming states such as image defects or void etc., due to an insufficient amount of developer can be definitely prevented.

What is claimed is:

1. An image forming apparatus comprising:

a supporting medium for supporting the developer;

an opposing electrode spaced a predetermined distance apart from the supporting medium and disposed facing the supporting medium;

a control electrode disposed between the supporting medium and the opposing electrode and having an arrangement of a plurality of gates which form passage for the developer particles, each gate having a center, said control electrode having a potential; and a drive controlling means which moves the surface of the supporting medium at a constant velocity relative to the control electrode, said image forming apparatus forming a visual image on a recording medium that is conveyed in a conveying direction by the drive controlling means at an other velocity between the opposing electrode and the control electrode whilst the potential applied to the control electrode is varied so as to selectively control transfer of the developer particles through the gates, said image forming apparatus further characterized in that the velocity of the supporting medium surface controlled by the drive controlling means is set at a higher rate than said other velocity of the recording medium, wherein said other velocity of the supporting medium surface controlled by the drive controlling means is controlled based on the velocity of recording medium relative to the control electrode, conditions of the arrangement of the gates in the control electrode and the size of the area to which no developer adheres, which is produced on supporting medium surface by the transfer of the developer through the gate;

wherein the velocity vs of the supporting medium surface controlled by the drive controlling means is controlled so as to satisfy the following conditions:

$$vs \leqq (d/t) \cdot \cos\theta - (1/t)(L^2 - d^2 \sin^2\theta)^{1/2}$$

where t is the shortest time interval between the voltage application to one gate and the voltage application to the proximal gate, d is the distance between a center of one gate and the center of a second gate for which a time of voltage application is closest to each other, L is a maximum length of a developer-free area on the supporting medium surface, and θ is the angle of a line connected between the centers of said one gate and said second gate, with respect to the conveying direction of the recording medium.

2. An image forming apparatus according claim 1, wherein the velocity vs of the supporting medium surface controlled by the drive controlling means is controlled so as to satisfy the following conditions:

$$L \leqq vs \cdot T$$

where L is a maximum length of developer-free area on the supporting medium surface and T is a shortest period of time during which a voltage for inhibiting passage of the developer is applied to a gate.

* * * * *